US008387508B2

(12) United States Patent
Niemi et al.

(10) Patent No.: US 8,387,508 B2
(45) Date of Patent: Mar. 5, 2013

(54) SUPPORT MEMBER FOR SUPPORTING SHELL, AND METHOD

(75) Inventors: Pekka Niemi, Jämijärvi (FI); Jussi Kautto, Nokia (FI); Seppo Hakari, Tampere (FI)

(73) Assignee: Patria Land Systems Oy, Helsinki (FI)

( * ) Notice: Subject to any disclaimer, the term of this patent is extended or adjusted under 35 U.S.C. 154(b) by 229 days.

(21) Appl. No.: 12/809,815

(22) PCT Filed: Jan. 30, 2009

(86) PCT No.: PCT/FI2009/050076

§ 371 (c)(1),
(2), (4) Date: Jul. 7, 2010

(87) PCT Pub. No.: WO2009/095538

PCT Pub. Date: Aug. 6, 2009

(65) Prior Publication Data

US 2010/0269722 A1 Oct. 28, 2010

(30) Foreign Application Priority Data

Jan. 31, 2008 (FI) ..... 20085080

(51) Int. Cl.
*F41F 3/04* (2006.01)

(52) U.S. Cl. ..... 89/1.806; 102/293

(58) Field of Classification Search ..... 102/293; 89/1.8–1.819

See application file for complete search history.

(56) References Cited

U.S. PATENT DOCUMENTS

| | | | | |
|---|---|---|---|---|
| 2,996,880 | A * | 8/1961 | Greiner | 60/251 |
| 4,444,115 | A * | 4/1984 | Romer et al. | 102/431 |
| 4,844,380 | A * | 7/1989 | Peoples et al. | 244/3.22 |
| 5,503,080 | A * | 4/1996 | Goward et al. | 102/293 |
| 5,685,503 | A * | 11/1997 | Trouillot et al. | 244/3.28 |
| 6,272,997 | B1 | 8/2001 | James et al. | |
| 6,637,699 | B2 * | 10/2003 | Banks et al. | 244/3.21 |
| 6,772,693 | B2 * | 8/2004 | Kuru et al. | 102/293 |
| 2004/0107857 | A1 * | 6/2004 | Kuru et al. | 102/293 |

FOREIGN PATENT DOCUMENTS

| | | |
|---|---|---|
| WO | WO 93/07439 A2 | 4/1993 |
| WO | WO 2004/003454 A1 | 1/2004 |

* cited by examiner

*Primary Examiner* — Samir Abdosh
(74) *Attorney, Agent, or Firm* — Birch, Stewart, Kolasch & Birch, LLP

(57) ABSTRACT

The invention relates to a support member for supporting a shell into the barrel of a breech-loading weapon, and a method. The support member (6) comprises means for fastening a support element (8) to at least one fin (5) belonging to the tail end (4) of a shell (1). The means comprise at least one fastening piece (10), which comprises: at least one first fastening surface (14*a*), which may be arranged substantially parallel with a side of the fin (5), and which fastening piece (10) may be supported to the support element (8); at least one second fastening surface (14*b*), which second fastening surface (14b) is movably arranged so that the second fastening surface (14*b*) is movable in relation to the first fastening surface (14*a*) in a direction transverse to the longitudinal axis (L) of the shell (1); and means for pressing the fastening surfaces (14*a*, 14*b*) against the sides of the fin (5) arranged between them so as to provide friction locking between the fastening piece (10) and the fin (5).

3 Claims, 5 Drawing Sheets

SUPPORT MEMBER FOR SUPPORTING SHELL, AND METHOD

FIELD OF THE INVENTION

The invention relates to a support member for supporting a shell into the barrel of a breech-loading weapon, the support member comprising a support element with a rim flange, and the support member further comprising means for fastening the support element to at least one fin belonging to the tail end of the shell.

The invention further relates to a method for fastening a support member to a shell, the method comprising: fastening to the tail end of the shell a support member that comprises a support element furnished with a rim flange, and locking the support member to at least one fin belonging to the tail end of the shell.

BACKGROUND OF THE INVENTION

A mortar may be arranged on a movable platform, such as on an armoured vehicle, whereby the mortar may be easily moved from one location to another, and on the other hand, it may be quickly moved to safety from an emplacement. If the mortar is to be fired horizontally or downward, a problem arises from the fact that the shell does not stay in place in the mortar barrel, but may slip forward in the barrel so that it can no longer be triggered. U.S. Pat. No. 5,503,080 discloses a support member that is fastenable by friction to the fins in the tail end of the shell. The solution taught by the publication has the problem that its application requires very exact measurements of both the tail end of the shell and the support member itself to be able to function at least fairly reliably.

BRIEF DESCRIPTION OF THE INVENTION

It is an object of the present invention to provide a novel and improved support member for supporting a shell into the barrel of a breech-loading weapon, and a method for fastening such a support member.

The support member of the invention is characterized in that the means for fastening the support element include at least one fastening piece, the fastening piece comprising:

at least one first fastening surface, which first fastening surface may be arranged substantially parallel with a side of the fin, and which fastening piece may be supported to the support element;

at least one second fastening surface, which second fastening surface is movably arranged so that the second fastening surface is movable in relation to the first fastening surface in a direction transverse to the longitudinal axis of the shell; and means for pressing the fastening surfaces against fin sides arranged between them so as to provide friction locking between the fastening piece and the fin.

The method of the invention is characterized by using at least one fastening piece for the locking, the fastening piece comprising:

at least one first fastening surface, which first fastening surface may be arranged substantially parallel with a side of the fin, and which fastening piece may be supported to the support element;

at least one second fastening surface, which second fastening surface is movably arranged so that the second fastening surface is movable in relation to the first fastening surface in a direction transverse to the longitudinal axis of the shell; and by pressing the fastening surfaces against the sides of a fin arranged between them so as to provide friction locking between the fastening piece and the fin.

The invention is based on the idea of locking the shell to the support member by fastening surfaces pressing against each other. An advantage of the invention is that the locking does not require great precision of the dimensioning of the fin or the fastening pieces.

According to an embodiment of the invention the fastening piece comprises a first arm provided with a first fastening surface and that the first arm is provided with a first spring means, which is arranged to press a fin of a shell arranged to the fastening piece against a second fastening piece, and, as a further option, in that the fastening piece comprises a second arm provided with a second fastening surface and that the second arm is provided with a second spring means arranged to press the a fin of a shell arranged to the fastening piece against the first fastening surface. An advantage in this is that the fastening piece is simple to manufacture, and no tools are required for the fastening.

According to a second embodiment of the invention the first fastening surface is arranged to a first lever member, which is pivotally fastened in relation to the second fastening surface by a shaft arranged transverse to the longitudinal axis of the shell, that the first lever member is provided with a second lever member arranged on the side of the shaft facing away from the first lever member, that in its released state the lever means tends to pivot so that the first fastening surface moves away from the second fastening surface and that a shell fin to be arranged between the fastening surfaces is arranged to turn the second lever means, whereby the first lever member arranged to the latter turns against the fin of the shell, thus producing a friction locking between the fastening piece and the fin. An advantage in this is that no tools are required for the fastening.

According to a third embodiment of the invention the first fastening surface is arranged to a first arm fastened to a first flange, the first flange being arranged to a plane transverse to the longitudinal axis of the shell, that the second fastening surface is arranged to a second arm fastened to a second flange, which is arranged parallel and co-axially with the first flange, the flanges rotating in relation to one another in the direction of their planes, and that the support member further comprises means, such as a screw and a wedge surface, for rotating the second flange in relation to the first flange in such a way that the fastening surfaces press against the sides of a fin arranged between them. An advantage in this is that the pressing force is easy to adjust.

BRIEF DESCRIPTION OF THE FIGURES

Some embodiments of the invention will be described in greater detail in the accompanying drawings, in which.

For the sake of clarity some embodiments of the invention have been simplified in the drawings. Like parts are indicated with like reference numerals.

DETAILED DISCLOSURE OF THE INVENTION

Figure 1:
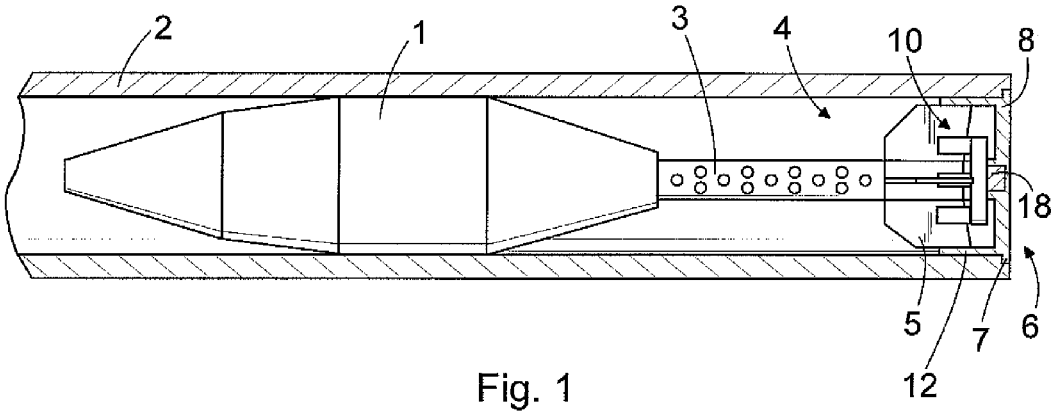
FIG. 1 is a schematic view of a shell supported into a barrel of a weapon by means of a support member according to an embodiment of the invention.

FIG. 1 is a schematic view of a shell supported into a barrel of a weapon by means of a support member according to an embodiment of the invention.

The shell 1 is arranged into the barrel 2 of a breech-loading weapon. The weapon may be a mortar in which the inner surface of the barrel 2 is essentially smooth. The rear of the shell 1 has a tail pipe 3 and a tail end 4. The tail end 4 comprises one or typically several fins 5 that are used to affect the flight path of the shell 1. The construction of the shell 1 may in detail differ from that shown in the figure. For the sake of clarity, the breech or other details of the weapon are not shown. A support member 6 of the invention is fastened to the tail end 4 so that the shell 1 may be kept in place in the barrel 2 until it is fired. A rim flange 7 on the support member 6 prevents the shell 1 from moving forward in the barrel 2 when the barrel 2 is directed in the horizontal direction or even downward. The support member 6 is dimensioned so that it endures the loads caused by the mass of the shell 1 and any forces caused by the vibration and accelerations generated during the transportation and handling of the shell.

Figure 2:
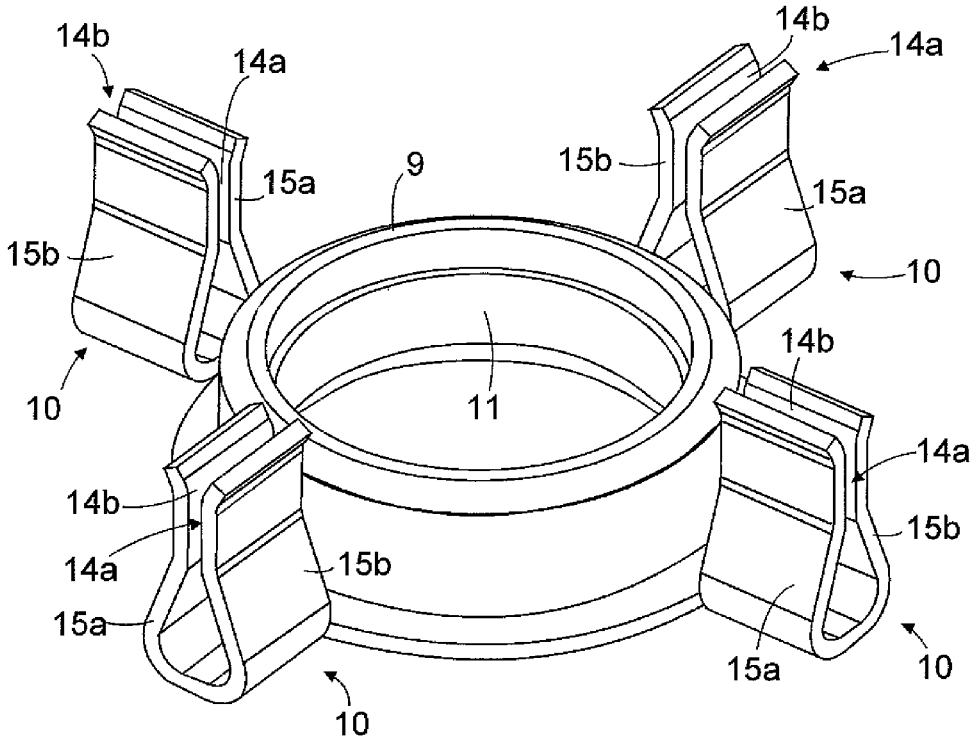
FIG. 2 is a schematic perspective view of some fastening means of the support member of the invention.

FIG. 2 shows perspective views of some fastening pieces of the support member of the invention. A total of four fastening pieces 10 are shown, and they are arranged to a support ring 9. The support ring comprises internal threads 11 that allow the support ring 9 to be fastened to threads 17 provided on the outer periphery of a sleeve 13 arranged to the mid-axis of the support element 8. It should be noted that the structure of the support element 8 is described in greater detail with reference to FIGS. 3*a* and 3*b*.

Each fastening piece 10 comprises a first fastening surface 14*a* arranged substantially parallel with a side of a fin 5. Further, each fastening piece comprises a second fastening surface 14*b*, which is also arranged substantially parallel to a side of the vane 5.

The first fastening surface 14*a* is arranged to a first arm 15*a* and, correspondingly, a second fastening surface 14*b* is arranged to a second arm 15*b*. Both arms 15*a*, 15*b* are made of springy material, the arms 15*am* 15*b* thus forming a first and a second spring member.

Figure 3A:
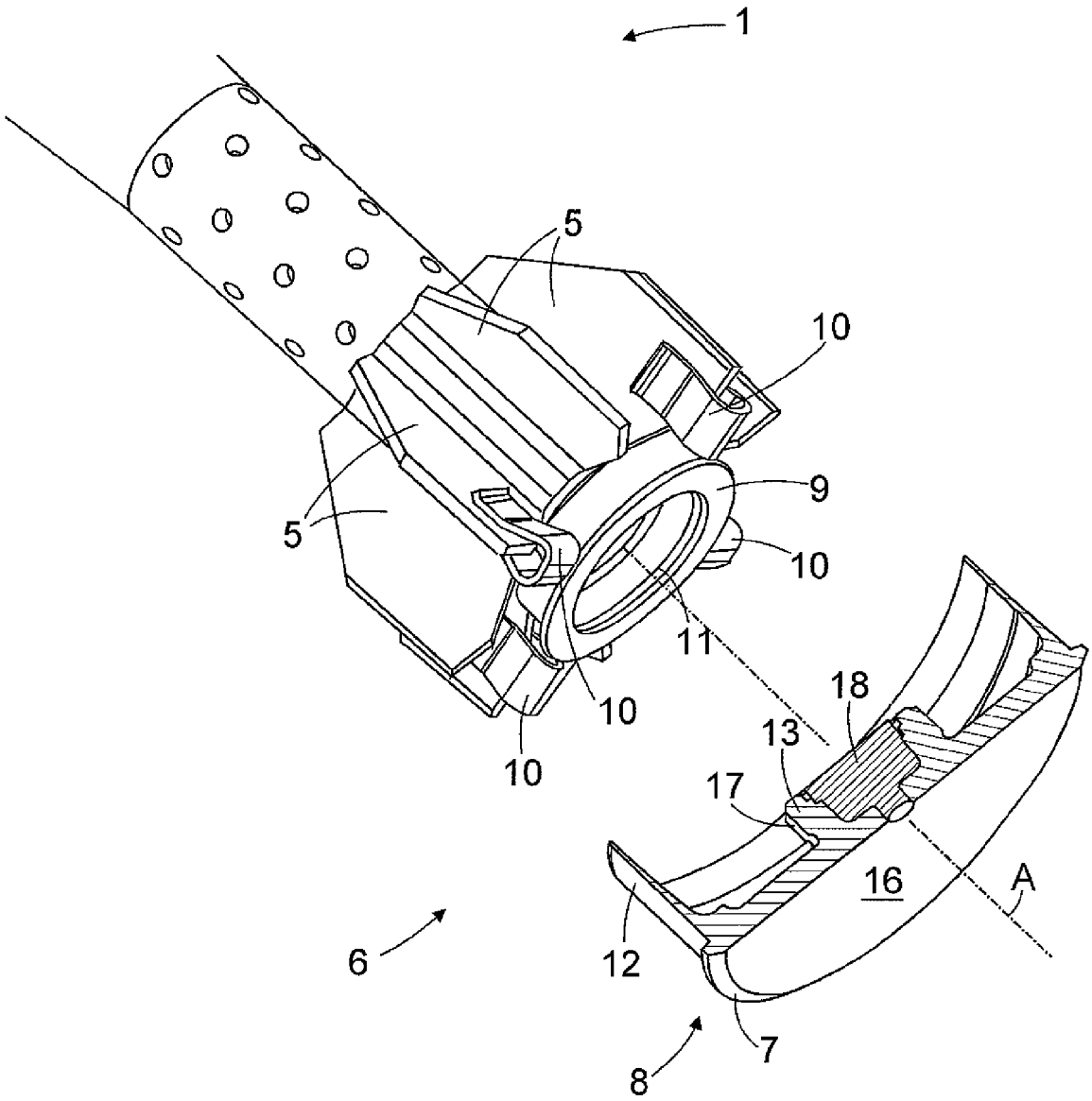
FIG. 3*a* is a schematic perspective view of a support element of the invention with its fastening means of FIG. 2 detached from the support element.
Figure 3B:
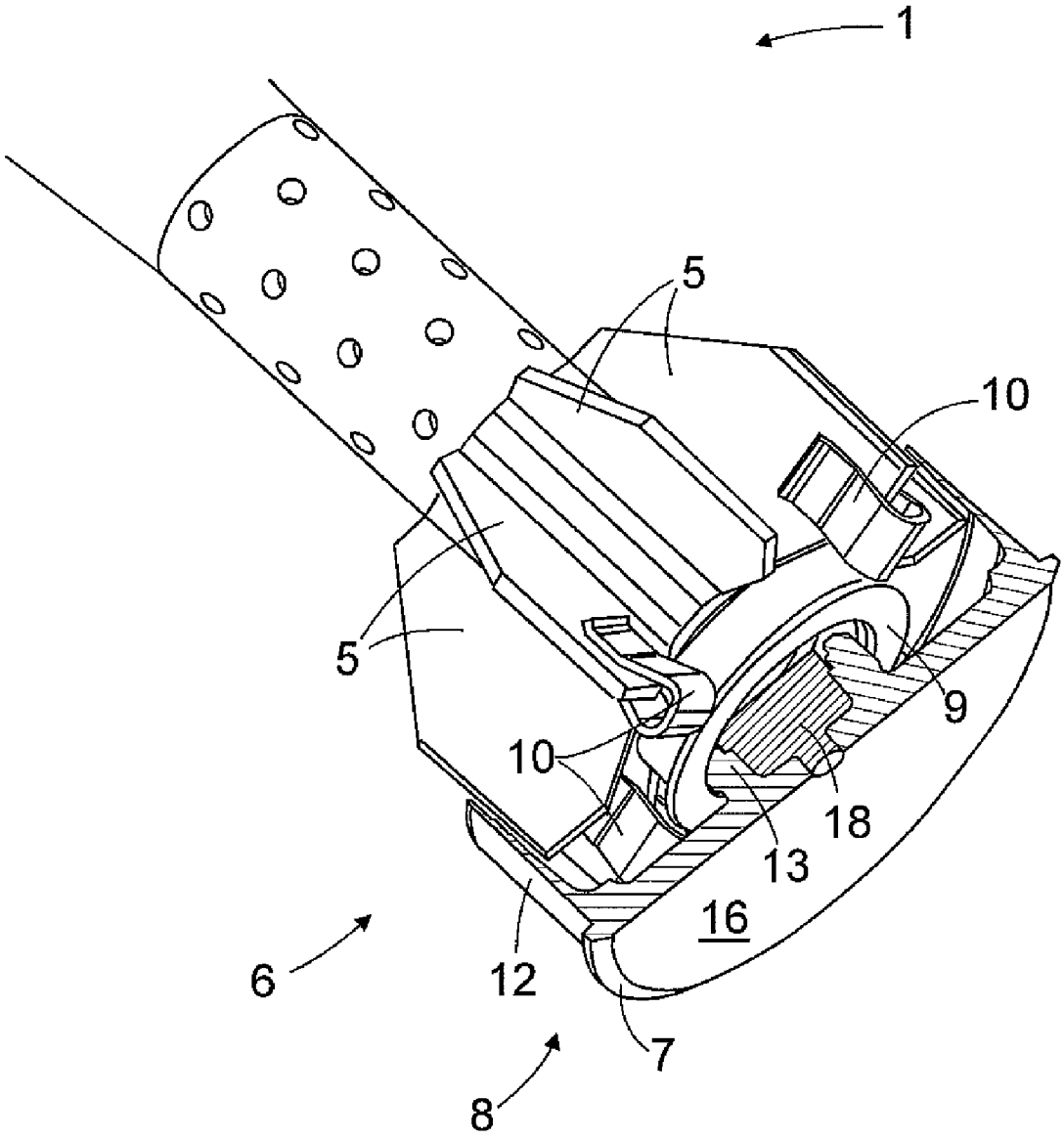
FIG. 3*b* is a schematic view of the support member of FIG. 3*a* in its assembled state and fastened to a shell.

FIG. 3*a* is a schematic perspective view of a support member of the invention with its fastening means of FIG. 2 detached from the support element, FIG. 3*b* showing the same support member in its assembled state and fastened to a shell.

The support element 8 comprises an end 16, outer casing 12 and rim flange 7. Further, the mid-axis A of the support element 8 is provided with a sleeve 13 having threads 17 on the outer periphery thereof. Further, inside the sleeve 13 there is provided a trigger mechanism 18 that may comprise an intermediate firing pin. The firing pin of the weapon may be arranged to hit a detonator cap of the shell 1 through the intermediate firing pin and to trigger the actual charge of the shell 1. Other trigger mechanisms known in the field may naturally also be used. The inner diameter of the sleeve 13 may be provided with threads to allow the trigger mechanism 18 to be detachably screwed inside the sleeve 13. The outer casing 12 of the support element 8 may be dimensioned so that at least part of the tail end 4 of the shell 1 may set therein. Further, the barrel 2 of the weapon may be provided with a groove into which the rim flange 7 of the support element 8 may set, when the shell 1 provided with the support element 6 has been loaded into the barrel 2.

The fastening pieces 10 are fastened to the fins 5. When a fin 5 is arranged between the fastening surfaces 14*a*, 14*b*, the fin 5 bends the arms 15*a*, 15*b* and the fastening surfaces 14*a*, 14*b* away from each other. The second fastening surfaced 14*b* is thus movably arranged in relation to the first fastening surface 14*a* in a direction transverse to the longitudinal axis A of the shell 1. The arms 15*a*, 15*b* tend to return closer to each other towards their tension-free state. This causes forces that press the fastening surfaces 14*a*, 14*b* against the sides of the fin 5. Friction locking is thus produced between the fastening surface 14*a*, 14*b* and the fin 5. One of the advantages of this arrangement is that the locking is not particularly sensitive as regards the manufacturing precision of the fin 5 and the fastening pieces 10.

According to a second embodiment of the invention only one of the arms 15*a*, 15*b* is bending, the other one being substantially rigid. In other words, only the first arm 15*a*, for example, comprises a spring member, whereas the second arm 15*b* does not.

There are also other ways of implementing the spring member. For example, the first or the second arm 15*a*, 15*b* may be attached to the support member 9 by a joint with a separate spring arranged thereto, the force of the spring pressing the fastening surface against the side of the fin 5.

The fastening members 10 and their spring members are dimensioned, on one hand, so as to resist to the required fastening forces, but, on the other hand, to allow the shell 1 to be detached from the support member 6 once firing has taken place. The fastening pieces 10 are preferably reusable.

The support member may be installed as shown in FIGS. 3*a* and 3*b*, for example, i.e. the fastening pieces 10 and the support ring 9 is fastened to the shell 1 first. Next, the support element 8 is screwed to the support ring 9. It is naturally also possible to fasten the support element 8 first to the support ring 9 and only then arrange the fins 5 of the shell 1 to the fastening pieces 10.

Figure 4A:
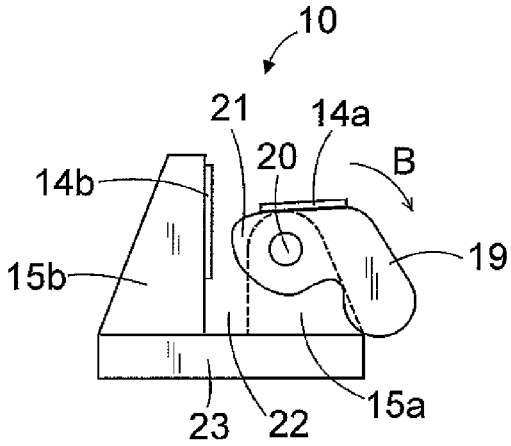
FIG. 4*a* is a schematic side view of a fastening piece of a second support member ready to receive a fin of a shell.
Figure 4B:
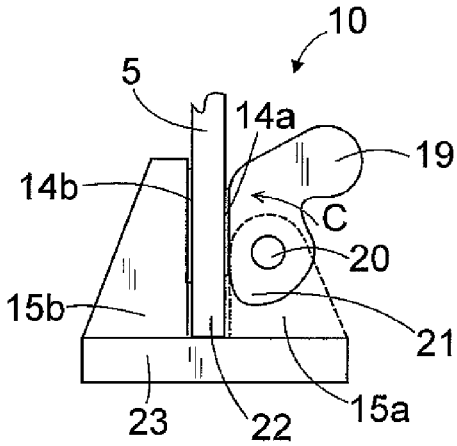
FIG. 4*b* is a schematic side view of the fastening piece of FIG. 4*a* with the fin of the shell fastened.

FIG. 4*a* is a schematic side view of a fastening piece of a second support member of the invention in a state ready to receive a fin of a shell, FIG. 4*b* being a schematic side view the fastening piece of FIG. 4*a* with the shell fin fastened therein.

The fastening piece 10 comprises two fastening surfaces, a first fastening surface 14*a* being arranged to a first lever member 19.

The first lever member 19 is pivotally fastened to the first arm 15*a* by a shaft 20 arranged transverse to the longitudinal axis of the shell. In order to simplify the illustration, the first arm is depicted with broken lines in FIGS. 4*a* and 4*b*. The second fastening surface 14*b*, in turn, is arranged to a second arm 15*b*. Both the first and the second arm 15*a*, 15*b* are fastened to a base 23, which in turn may be fastened to the support element 8. Naturally it is also possible that the arms 15*a*, 15*b* and the base 23 form a single piece.

The first lever means 19 is provided with a second lever means 21 arranged on the side of the shaft 21 facing away from the first lever means 19. The first and second lever means 19, 21 may form a single piece, or they may be separate pieces arranged together. The rotating force caused by the first lever means 19 is substantially greater than the rotating force of the second lever means 21. For this reason, when in their released state, the lever members then to turn in the direction of arrow B into the position shown in FIG. 4*a*. In that case the first fastening surface 14*a* has rotated away from the second fastening surface 14*b*.

When a fin 5 of a shell is pushed into the space 22 between the arms 15*a*, 15*b*, the fin 5 pushes the second lever member 21 to the side. Hence the lever members 19, 21 turn, forced by the fin 5, to the direction of arrow C. The first lever member turns against the fin 5 of the shell, thereby causing friction locking between the fastening surfaces 14*a*, 14*b* and the fin 5.

When the shell is fired, the friction force between the fastening surfaces 14*a*, 14*b* and the fins 5 is exceeded, and the shell is detached from the fastening pieces 10. The fastening pieces 10 do not damage the fins 5, nor do any loose pieces come off them during the firing.

The parts of the fastening piece 10 may be manufactured of a surface-hardened steel, for example. The fastening pieces 10 are preferably re-usable.

Figure 5:
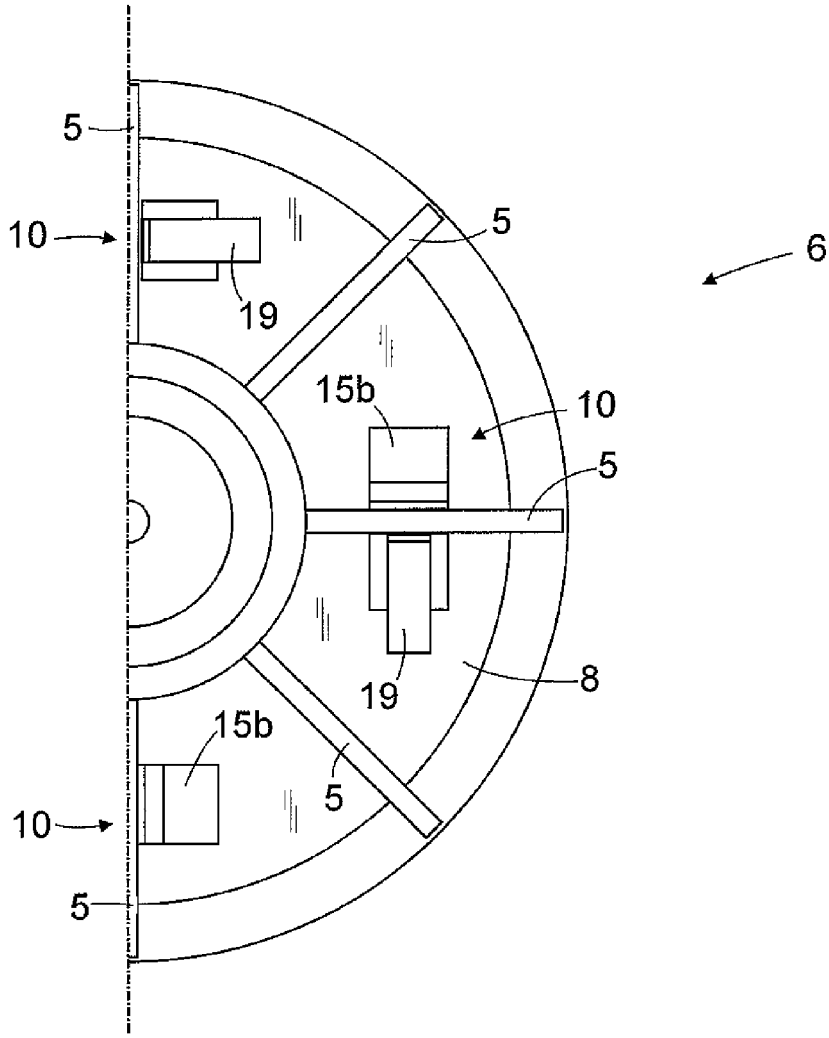
FIG. 5 is a schematic view of the support member of FIG. 4 seen from the direction of the shell.

FIG. 5 is a schematic view of fastening members of FIGS. 4*a* and 4*b* arranged to a support member and seen from the direction of the shell. Only the fins 5 of the shell are shown, their number being eight in this case. The support member 6 comprises fastening pieces 10 so that every second fin 5 is arranged to a separate fastening piece 10.

The fastening pieces 10 may be fastened to the support member 6 by means of screws, for example, or other similar fastening members that may be opened, or by welding or by some other non-openable fastening means.

Figure 6:
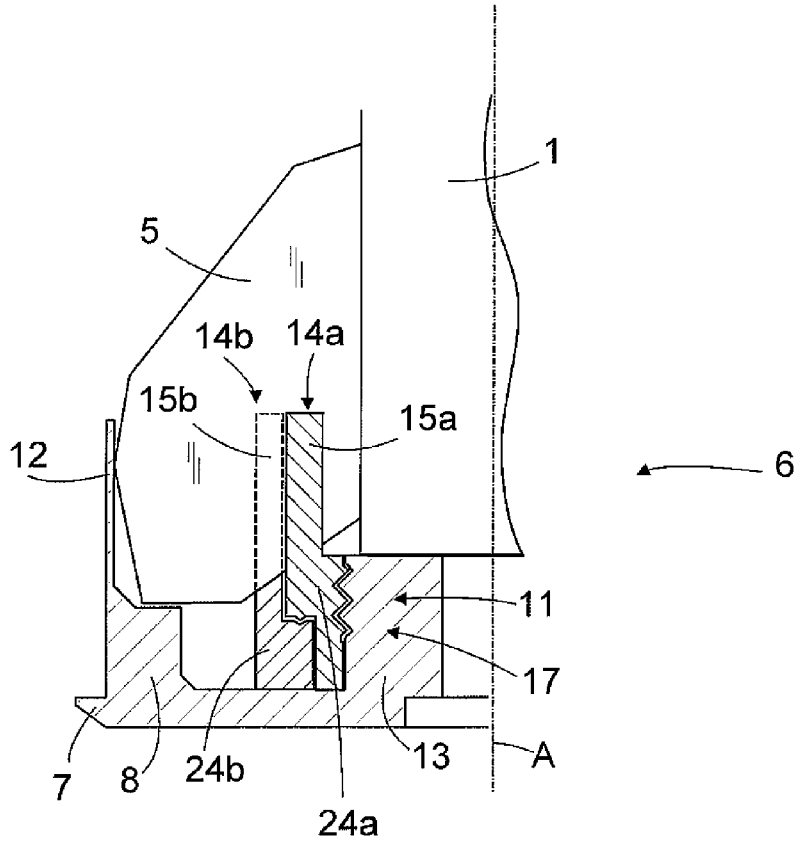
FIG. 6 is a schematic side view of a third support member of the invention.

FIG. 6 is a schematic, partly cross-sectional side view of a third support member of the invention. It should be noted that the support member 6 and the shell 1 are only partly shown both in FIG. 6 and in FIG. 7.

The first fastening surface 14*a* of the support member 6 is arranged to the first arm 15*a*, which in turn is fastened to the first flange 24*a*. The first flange 24*a* is arranged to a plane transverse in relation to the longitudinal axis A of the shell 1. The first flange 24*a* is fastened to the support element 8; in this case through internal threads 11 to threads 7 on the outer surface of the sleeve 13. Naturally there are also other ways of implementing the fastening.

The second fastening surface 14*b* of the support member 6 is arranged to the second arm 15*b*, which is fastened in turn to the second flange 24*b*. The second flange 24*b* is arranged parallel to the first flange 24*a*, and it comprises an opening, into which the first flange 24*a* is partly arranged. The second flange 24*b* may be rotated around the sleeve 13 in relation to the first flange 24*a* in the direction of the plane of the flanges 24*a*, 24*b*.

The shell 1 is arranged to the support member 6 in such a way that the fin 5 is between the arms 15*a*, 15*b* and therefore between the fastening surfaces 14*a*, 14*b*. The second arm 15*b* with its fastening surfaces 14*b* is shown with broken lines in FIG. 6, because they are on the reverse side of the fin 5.

Figure 7:
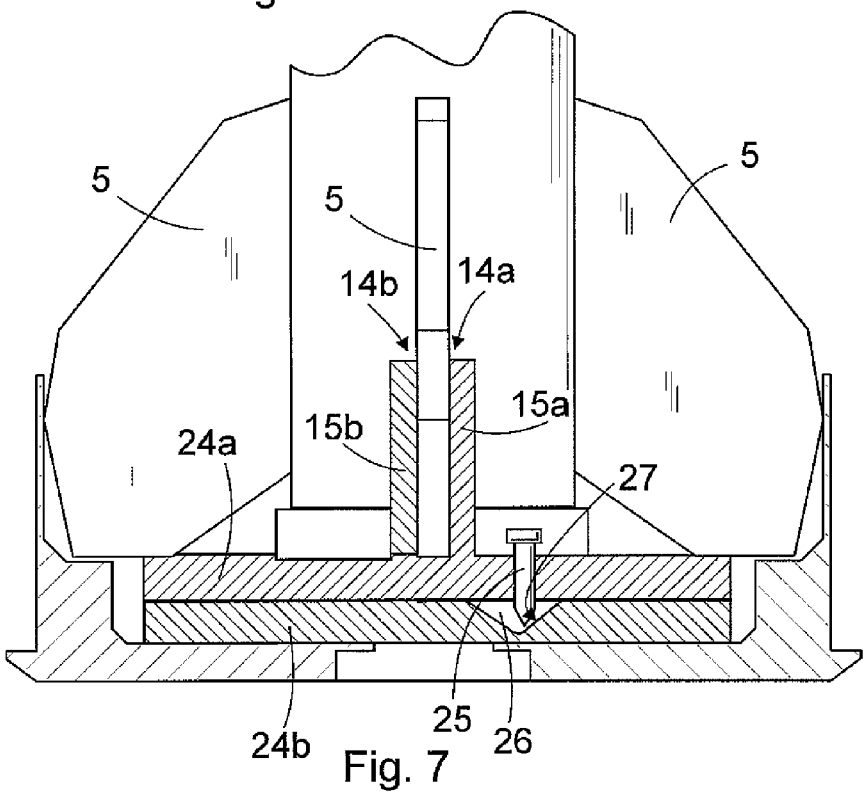
FIG. 7 is a schematic side view of the support member of FIG. 6.

FIG. 7 is a schematic, partly cross-sectional side view the fastening piece of FIG. 6. FIG. 7 shows a view rotated by 90° in relation to the one in FIG. 6. As is seen in the figure, the first arm 15*a* and the second fastening surface 14*a* are on a first side of the fin 5, whereas the second arm 15*b* and the second fastening surface 14*b* are on a second side of the fin. The fin 5 is thus between these parts.

The support member 6 comprises means for rotating the second flange 24*b* and the second arm 15*b* and the second fastening surface 14*b* arranged thereto in relation to the first flange 24*a* and the first arm 15*a* and the firs fastening surface 14*a* arranged thereto so that the fastening surfaces 14*a*, 14*b* may be pressed against the sides of the fin 5 arranged between them. In the embodiment shown in FIGS. 6 and 7 said means comprise a screw 25 arranged to a threaded hole traversing the first flange. The second flange 24*b* is provided with a wedge recess 26, which is arranged in relation to the screw 25 in such a way that the screw 25 is rotatable against the wedge surface 27 of the wedge recess 26. The screw 25 to be screwed against the wedge surface 27 forces the second flange 24*b* to rotate in relation to the first flange 24*a* so that the fastening surfaces 14*a*, 14*b* approach one another. The fastening surfaces 14*a*, 14*b* may thus be pressed and tightened against the sides of the fin 5. The magnitude of the tightening torque of the screw 25 may be used to act on the friction force affecting the fin 5. The support member 6 may comprise one, but preferably two, three or even more screws 25 and a necessary number of wedge recesses 26. Upon firing, the shell 1 is detached from the support member 6 without any pieces of the support member 6 coming off with the shell 1. The support member 6 is preferably re-usable.

It should be noted that there are also other ways of screwing and locking the flanges 24*a*, 24*b* in relation to each other.

In some cases the features of this application may be applied independently, irrespective of the rest of the features. On the other hand, the features presented in this application may also be combined, when necessary, to provide different combinations.

The drawings and the related specification are only meant to illustrate the inventive idea. The details of the invention may vary within the scope of the claims. It is evident that the number of the fastening pieces 10 may be selected according to the required fastening force and number of fins 5. It is also evident that the fastening surface 14*a*, 14*b* may be of the same material as the corresponding arm 15*a*, 15*b*, or of some other material, whose friction and other characteristics are suitable for friction locking. The surface of the fastening surface 14*a*, 14*b* may be smooth or, alternatively, suitably shaped, for example by grooves or roughened—even to the extent that the fastening surface functions as an abrasive material against the fin 5. The fastening piece 10 may be manufactured of a metal sheet by cutting and bending. Alternatively, it may be cast of metal. Further, the fastening piece 10 may be manufactured of a plastic material by injection moulding, for example, or it may be a composite structure.

The invention claimed is:

1. A support member for supporting a shell into the barrel of a breech-loading weapon, the support member comprising a support element with a rim flange, and the support member further comprising means for fastening the support element to at least one fin belonging to the tail end of the shell, the means for fastening the support element include at least one fastening piece, the fastening piece comprising:

at least one first fastening surface, which first fastening surface may be arranged substantially parallel with a side of the fin;

at least one second fastening surface, which second fastening surface is movably arranged so that the second fastening surface is movable in relation to the first fastening surface in a direction transverse to the longitudinal axis of the shell; and means for pressing the fastening surfaces against the sides of the fin arranged between them so as to provide friction locking between the fastening piece and the fin, wherein the means for pressing the fastening surfaces comprises a first arm provided with said first fastening surface and a first spring means, said first spring means being arranged to cause the force that presses the fin arranged to said fastening piece against the second fastening surface, said first spring means being arranged to act independently and separately in respect of the spring means of the fastening pieces fastened to the other fins of the shell, the support element comprises an end and an annular outer casing, and the annular outer casing has an annular shape and extends from the end to a side of the end where the fastening pieces lie, and the annular outer casing surrounds the fastening pieces.

2. The support member according to claim 1, wherein the fastening piece comprises a second arm provided with a second fastening surface and that the second arm is provided with a second spring means arranged to press the fin of the shell arranged to the fastening piece against the first fastening surface.

3. A method for fastening a support member to a shell, the method comprising:

fastening to the tail end of the shell a support member that comprises a support element furnished with a rim flange, locking the support member to several fins belonging to the tail end of the shell using in the locking several fastening pieces, the fastening piece comprising:

at least one first fastening surface, which first fastening surface is arranged substantially parallel with a side of the fin;

at least one second fastening surface, which second fastening surface is movably arranged so that the second fastening surface is movable in relation to the first fastening surface in a direction transverse to the longitudinal axis of the shell;

pressing the fastening surfaces against the sides of a fin arranged between them so as to provide friction locking between the fastening piece and the fin; and causing the force pressing the first fastening surface and the fin towards the second fastening surface by said first spring means, said first spring means as well as said first fastening surface arranged in a first arm, said first spring means being arranged to act independently and separately in respect of the spring means of the fastening pieces fastened to the other fins of the shell, wherein the support element comprises an end and an annular outer casing, and the annular outer casing has a annular shape and extends from the end to a side of the end where the fastening pieces lie, and wherein the annular outer casing surrounds the fastening pieces.

* * * * *